US005899682A

United States Patent [19]

Henderson et al.

[11] Patent Number: 5,899,682

[45] Date of Patent: May 4, 1999

[54] DEVICE FOR PREVENTING FLAREUP IN LIQUID FUEL BURNERS BY REGULATING FUEL FLOW FROM THE REMOVABLE FUEL TANK

[76] Inventors: Richard W. Henderson, P.O. Box 12681, Florence, S.C. 29504; Kerryl Lynne Henderson, 2976 Hwy. 112, DeRidder, La. 70634

[21] Appl. No.: 08/829,037

[22] Filed: Mar. 31, 1997

[51] Int. Cl.[6] ..... F23N 1/00; B67D 5/60

[52] U.S. Cl. ..... 431/12; 431/64

[58] Field of Search ..... 431/12, 64, 319, 431/302, 29; 126/93, 95, 96; 222/457; 141/198, 364, 18

[56] References Cited

U.S. PATENT DOCUMENTS

| | | | |
|---|---|---|---|
| 1,392,187 | 9/1921 | Mahan | 137/405 |
| 1,623,161 | 4/1927 | Buerger | 137/405 |
| 1,706,704 | 3/1929 | Phillips | 137/405 |
| 1,725,538 | 8/1929 | Remnsnider | 137/405 |
| 2,165,162 | 7/1939 | Thornton | 431/117 |
| 2,186,128 | 1/1940 | Ullstrand | 137/434 |
| 2,189,871 | 2/1940 | Thomas | 126/96 |
| 2,717,590 | 9/1955 | Stelle et al. | 126/96 |
| 3,169,519 | 2/1965 | Aizawa . | |
| 3,501,252 | 3/1970 | Richardson . | |
| 4,363,620 | 12/1982 | Nakamura . | |
| 4,588,371 | 5/1986 | Nakamura et al. | 126/93 |
| 4,610,239 | 9/1986 | Nakamura et al. | 126/96 |
| 4,614,493 | 9/1986 | Nakamura et al. | 126/93 |
| 4,664,095 | 5/1987 | Takahashi . | |
| 4,797,088 | 1/1989 | Nakamura . | |
| 4,805,589 | 2/1989 | Nakanishi et al. | 126/96 |
| 4,872,831 | 10/1989 | Fujimoto . | |
| 5,080,578 | 1/1992 | Josephs . | |
| 5,165,883 | 11/1992 | Van Bemmel . | |
| 5,338,185 | 8/1994 | Henderson et al. | 431/34 |
| 5,409,370 | 4/1995 | Henderson | 431/2 |
| 5,456,595 | 10/1995 | Henderson . | |
| 5,549,470 | 8/1996 | Henderson . | |
| 5,551,865 | 9/1996 | Henderson et al. . | |

FOREIGN PATENT DOCUMENTS

| | | |
|---|---|---|
| 1205018 | 9/1970 | United Kingdom . |

OTHER PUBLICATIONS

Richard W. Henderson and George R. Lightsey, "Kerosene Heater Fires: Barometric Type," *Fire Marshals Bulletin* (87–5), pp. 8–10, Nov. 1987.

Richard W. Henderson and George R. Lightsey, "Kerosene Heater Fires: Barometric Type," *The National Fire and Arson Report*, vol. 61), pp. 2–4 (1988).

Richard W. Henderson, "Barometric Kerosene Heaters," *Fire and Arson Investigator* vol. 39 (3), pp. 26–27 (1989).

John J. Lentini, "Gasoline and Kerosene Don't Mix–At Least, Not in Kerosene Heaters," *Fire Journal*, vol. 83 (4), pp. 13, 86 (1989) (Jul.–Aug.).

Richard W. Henderson and George R. Lightsey, "An Anti–Flareup Device for Barometric Kerosene Heaters," *Fire and Arson Investigator*, vol. 45 (2), 8 (1994).

Richard W. Henderson, "Barometric Kerosene Heaters, An Overview of Failure Modes and Solutions," *Fire and Arson Investigators*, vol. 46 (4), 11 (1996).

*Primary Examiner*—Ira S. Lazarus
*Assistant Examiner*—Sara Raab
*Attorney, Agent, or Firm*—David Pressman

[57] ABSTRACT

A safety device for preventing uncontrolled burning in wick-fed liquid fuel burners of the type where a removable tank (60) feeds a fuel chamber (40), which supplies the fuel to a wick (54) via a sump opening in the upper surface of the chamber (40). A plate (32) in the removable tank (60) contains an orifice (34), which restricts fuel egress from the tank. A fill tube (44) traverses the plate. An inner equalization tube (24), a chamber (30), and an outer equalization tube (28) are connected to the fill tube (44).

12 Claims, 2 Drawing Sheets

DEVICE FOR PREVENTING FLAREUP IN LIQUID FUEL BURNERS BY REGULATING FUEL FLOW FROM THE REMOVABLE FUEL TANK

CROSS-REFERENCE TO RELATED APPLICATIONS

This invention is an improvement over the inventions of several earlier applications, to-wit:

Ser. No. 08/130,290, filed Oct. 4, 1993, now U.S. Pat. No. 5,338,185, granted Aug. 16, 1994, in the names of Richard W. Henderson and George R. Lightsey;

Ser. No. 08/247,925, filed May 23, 1994, now U.S. Pat. No. 5,456,595, granted Oct. 10, 1995, in the name of Richard W. Henderson;

Ser. No. 08/297,048, filed Sep. 30, 1994, now U.S. Pat. No. 5,409,370, granted Apr. 25, 1995, in the name of Richard W. Henderson;

Ser. No. 08/365,804, filed Dec. 29, 1994, now U.S. Pat. No. 5,549,470, granted Aug. 27, 1996, in the name of Richard W. Henderson;

Ser. No. 08/514,583, filed Aug. 14, 1995, now U.S. Pat. No. 5,662,468, granted Sep. 2, 1997 in the name of Richard W. Henderson;

Ser. No. 08/559,922, filed Nov. 17, 1995, now U.S. Pat. No. 5,551,865, granted Sep. 3, 1996, in the names of Richard W. Henderson and Samuel R. Henderson;

Ser. No. 08/684,131, filed Jul. 19, 1996, now U.S. Pat. No. 5,730,115, granted Mar. 24, 1998, in the name of Richard W. Henderson; and Ser. No. 08/684,132 filed Jul. 19, 1996, now U.S. Pat. No. 5,772,425, granted Jun. 30, 1998 in the name of Richard W. Henderson.

BACKGROUND

1. Field of Invention

This invention relates to safety devices, specifically to a mechanism for prevention of flareup in barometric-type wick-fed liquid fuel burners.

2. Discussion of Prior Art

Wick-fed liquid fuel burners, such as kerosene heaters, are used for space or area heating In cabins, mobile homes, and the like. In such burners liquid fuel from a fuel chamber is supplied to a wick which is exposed to the oxygen of the atmosphere. Once the wick has been ignited, flame intensity and heat generation are controlled by adjusting the length of the wick exposed within a wick-receiving combustion chamber.

A common type of kerosene heater is the barometric style, in which gravity causes liquid fuel to be delivered to a horizontal fuel chamber from a vertically-oriented, removable tank inserted into a mating well, or sump, in a top surface of the fuel chamber. In some cases a sight gauge is mounted on the side of the removable tank to monitor the fuel level in that tank when the tank is filled, and during operation of the burner. The flow of fuel from the removable tank into the fuel chamber is governed by a barometric valve in the cap on the removable tank, which, in normal operation, maintains the level of the fuel in the fuel chamber at the level of the barometric valve. A partial vacuum above the fuel in the removable tank prevents the fuel from flowing into the fuel chamber until the fuel level in the fuel chamber drops below the barometric valve, which allows air to enter the removable tank. As air enters the removable tank through the barometric valve, fuel in the removable tank flows into the fuel chamber until its level in the fuel chamber rises and covers the barometric valve in the removable tank cap, causing fuel flow from the removable tank to cease.

The barometric valve consists of a spring-loaded plunger, which has an enlarged head at one end. When the removable tank is inserted into the fuel chamber, the plunger head contacts a pin located in the fuel chamber, which pushes the plunger back, allowing the fuel in the removable tank to be in fluid communication with the fuel chamber.

When the tank is removed, the action of the spring on the plunger head forces it against the opening in the tank cap, sealing the opening and preventing fuel from leaving the tank. The capacity of the removable tank is typically about four to five liters (four to five quarts), while the fuel chamber can hold a maximum of about two liters (two quarts).

Various improvements have been made to such burners which make them safer to operate. For example, tip-over shut-off mechanisms, manual shut-off devices, and low-level $O_2$ detectors have been employed. However, these burners continue to cause fires that result in death, injury, and property loss. These fires are caused, because, when high-volatility fuels are present in the burner, under certain conditions, vapors from the sump area can be ignited by the wick flame, and in other cases, fuel can overflow the fuel chamber. When the overflowing fuel ignites, the result is an uncontrolled fire, or flareup.

The most common reason for fuel overflow is the inadvertent use of fuels with high vapor pressures. Examples of such fuels are gasoline, naphtha, and inferior kerosene, which has a low flash point. In a barometric heater, overflow of fuel from the fuel chamber can occur if the partial vacuum in the removable tank is lost. As the temperature of the heater and its surroundings increases, the vapor pressure of the fuel in the removable tank increases and, under certain conditions, allows fuel to escape from the removable tank at a rate greater than the rate of wick-controlled burning of the fuel. Should this process continue, the fuel chamber will overflow, since the removable tank holds about two to three liters (two to three quarts) more than the capacity of the fuel chamber. When the fuel chamber overflows, the fuel spills onto the top of the fuel chamber, and can then ignite, causing an uncontrolled fire. A second way that the partial vacuum in the barometric heater's removable tank can be lost is by air entering the removable tank due to compromise of its integrity.

There are safety devices that drop the wick down, thereby extinguishing the flame, if the burner tips over or experiences excessive vibration, or if abnormal combustion is detected. Other safety devices detect high levels of $CO_2$ and low levels of $O_2$ in the vicinity of the heater, and use these to control burning rates. Still others regulate the position of the wick during the ignition and extinguishing operations of the heater to prevent excessive flaming during these operations. Examples are shown in U.S. Pat. Nos. 4,363,620, issued Dec. 14, 1982 to Nakamura; 4,872,831, issued Oct. 10, 1989 to Fujimoto; 4,797,088, issued Jan. 10, 1989 to Nakamura; and 5,165,883, issued Nov. 24, 1992 to Van Bemmel. However, not only do these devices fail to prevent flareup, they are ineffective in stopping flareup after its onset. In some cases, the safety devices require the use of electrical power and electronic circuitry for actuation: this increases the cost of the burners significantly, without rectifying the flareup problem.

It has been suggested in two publications ("Kerosene Heater Fires: Barometric Type," R. Henderson et al., *Fire*

*Marshals Bulletin* (*National Fire Protection Association*), Vol. 87-5, p. 8 (1987); "Barometric Kerosene Heaters," R. Henderson, *Fire and Arson Investigator* (International Association of Arson Investigators), Vol. 39, No. 3, p. 26 (1989)) to make the size of the removable tank of barometric kerosene heaters comparable in volume to that of the fuel chamber so that flooding of the fuel chamber will not occur. To implement this suggestion, either the capacity of the removable tank must be reduced, or alternatively, that of the fuel chamber must be increased. However, reducing the capacity of the removable tank will reduce the burn time accordingly, and possibly affect the marketability of the heaters. Increasing the capacity of the fuel chamber will require that new tanks be designed and implemented and could increase the size of the burner to an unacceptable level.

Also, it has been suggested that a float device be introduced into the fuel chamber to be used to activate the automatic wick extinguishing mechanism, and a sight gauge be present to show dangerous fuel levels in the fuel chamber. Introduction of such a float device would also require that the fuel chamber be redesigned, as discussed above. Although some burners have sight gauges in the fuel chamber, the sight gauges are used only to indicate whether or not fuel is present, not when dangerous fuel levels are present in the fuel chamber.

In addition it was proposed that a tank block-out device be installed. In this, a float in the fuel chamber pushes a pin that moves if the removable tank is withdrawn from the heater. Once again, such a device would require a redesigning of the fuel chamber and insertion of moving parts inside a somewhat restricted space.

U.S. Pat. No. 5,080,578, issued Jan. 14, 1992 to Josephs, claims that its device controls flareup in wick-fed liquid fuel burners by a) cutting off the flow of fuel to the wick in response to excessive heat by blocking a fuel line, and b) withdrawing the wick into the wick chamber when sensing excessive heat. However, Josephs' device has several disadvantages:

a) Excessive heat must be gene rated near the sensors before the flow of fuel is interrupted, or the wick is withdrawn. Therefore, since flareup is not prevented, the device only limits the spread of excessive flames after flareup has al ready occurred.

b) Heat sensing devices must be near the area where uncontrolled burning is taking place due to overflow of fuel. But often the path that the overflowing fuel takes is random and flareup may not initially occur near the heat sensors.

c) The device is not applicable to barometric liquid fuel burners—one of the most common wick-fed liquid fuel burners in use—because these burners do not have fuel lines.

d) From the onset of flareup in wick-fed liquid fuel burners, fire is present outside the wick; therefore, retracting the wick does not affect the flareup process.

The device of the above U.S. Pat. No. 5,338,185 of Henderson and Lightsey consists, in part, of an excess fuel containment compartment below the level of the fuel chamber. It prevents flareup by activating a wick-extinguishing mechanism when the presence of excess fuel is detected in the fuel chamber. While this device has much merit, to be effective it requires activation of a second mechanism, that is, an automatic wick extinguisher. Should that mechanism fail to respond, due to tar buildup on the wick or a mechanical problem, flareup may still occur in some situations.

The device of the above U.S. Pat. No. 5,456,595 of Henderson prevents flareup by lifting the removable tank when excess fuel is present in the fuel chamber, thereby shutting off the barometric valve and stopping fuel flow from the removable tank. For this device to work, a spring must be provided to lift the removable tank and its contents (liquid fuel), the total weight of which can be up to some five kilograms (ten pounds). Accordingly, should the spring lose strength, or should the removable tank become hindered in its upward movements this device may not be able to prevent flareup in some situations.

The device of the above U.S. Pat. No. 5,409,370 of Henderson prevents flareup by dropping the pin which holds open the barometric valve in the removable tank cap, thereby closing the valve and stopping fuel flow into the fuel chamber. Should the valve not close properly, this device may not prevent flareup in some situations.

The device of the above U.S. Pat. No. 5,549,470 of Henderson prevents flareup by providing a thermal barrier between the combustion cylinder and the removable tank, which helps lower the temperature of the removable tank so that fuel vapor pressures do not become excessive. In addition, it includes a warning gauge that alerts the user to the dangerous condition of the burner when excess fuel is present in the fuel chamber. It also provides an excess fuel containment system that can hold the entire contents of the removable tank should all the fuel be released rapidly.

This system consists, in part, of a fuel containment sump, which extends upward from the top of the fuel chamber, and which surrounds the removable tank, but which does not have a closure at its top. This device has much merit in that it is effective without involving any moving parts for its operation. However, the presence of the components of the device would add to the weight of the burner.

The device of the above U.S. Pat. No. 5,662,468 prevents flareup by containing fumes in the vicinity of the removable tank and by providing (a) a closure at the top of the compartment housing the removable tank, and (b) a block-out mechanism for the removable tank should excess fuel be present in the fuel chamber. Although this device also has much merit, it requires the introduction of a tank block-out mechanism in the sump in a somewhat restricted space.

The device of the above U.S. Pat. No. 5,730,115, acts to prevent flareup by providing a float in the fuel chamber, which float rises in response to the presence of excess fuel in the fuel chamber. As the float rises, it moves a member which obturates an opening from the sump to the chamber, causing the opening into the fuel chamber to be closed. Should the float fail to respond, or if the opening does not seal properly, excess fuel will continue to flow into the chamber, which may result in flareup.

The device of the above U.S. Pat. No. 5,772,425, prevents flareup by containing vapors in the sump area when the removable fuel tank is inserted into the fuel chamber. A gasket contains vapors present in the sump area when the tank is seated in the sump opening. When the tank is removed from the sump opening, a plate moves upward due to the action of a spring and contains vapors in the sump area. While this device is quite effective in preventing flareup due to vapor migration from the sump area, it does not prevent flareup should excess fuel enter the fuel chamber, causing an overflow of fuel from the fuel chamber.

The device of the above U.S. Pat. No. 5,551,865 of Henderson and Henderson employs a thermocouple/solenoid/lever system, which lever must be engaged until the wick flame is established sufficiently such that the solenoid can maintain the position of the lever so that it does not actuate the automatic wick extinguishing mechanism.

Should excess fuel enter the fuel chamber, a float causes the thermocouple/solenoid circuit to open, which releases the lever, actuating the wick extinguishing mechanism. This device has the advantage that there is a self-test of the system each time the burner is operated. On the other hand, the device requires electrical circuitry and components for its operation. Also, should the wick extinguishing mechanism fail to operate, flareup may result.

OBJECTS AND ADVANTAGES

Accordingly, several objects and advantages of the present invention are to provide an improved and safer wick-fed, barometric, liquid fuel burner, to provide such a burner with a safety device which does not require the reduction in capacity of the removable fuel tanks does not require the redesigning of the fuel chamber to increase its capacity, does not require electrical power or electronic circuitry, does not require the presence of excessive heat for its actuation, is applicable to kerosene heaters that do not have fuel lines, and provides for the metering of the flow of fuel from the removable fuel tank, without requiring any modification of the burner other than the removable fuel tank.

In addition, the present burner is quite simple in design and inexpensive to incorporate, does not have any substantially increased weight, will save lives and property, will make barometric liquid fuel burners easier to market because of added safety value, and will likely reduce the number of expensive lawsuits prompted by injury, loss of life, and property damage.

Still further objects and advantages will become apparent from a consideration of the ensuing description and drawings.

DRAWING REFERENCE NUMERALS

Figure 1:
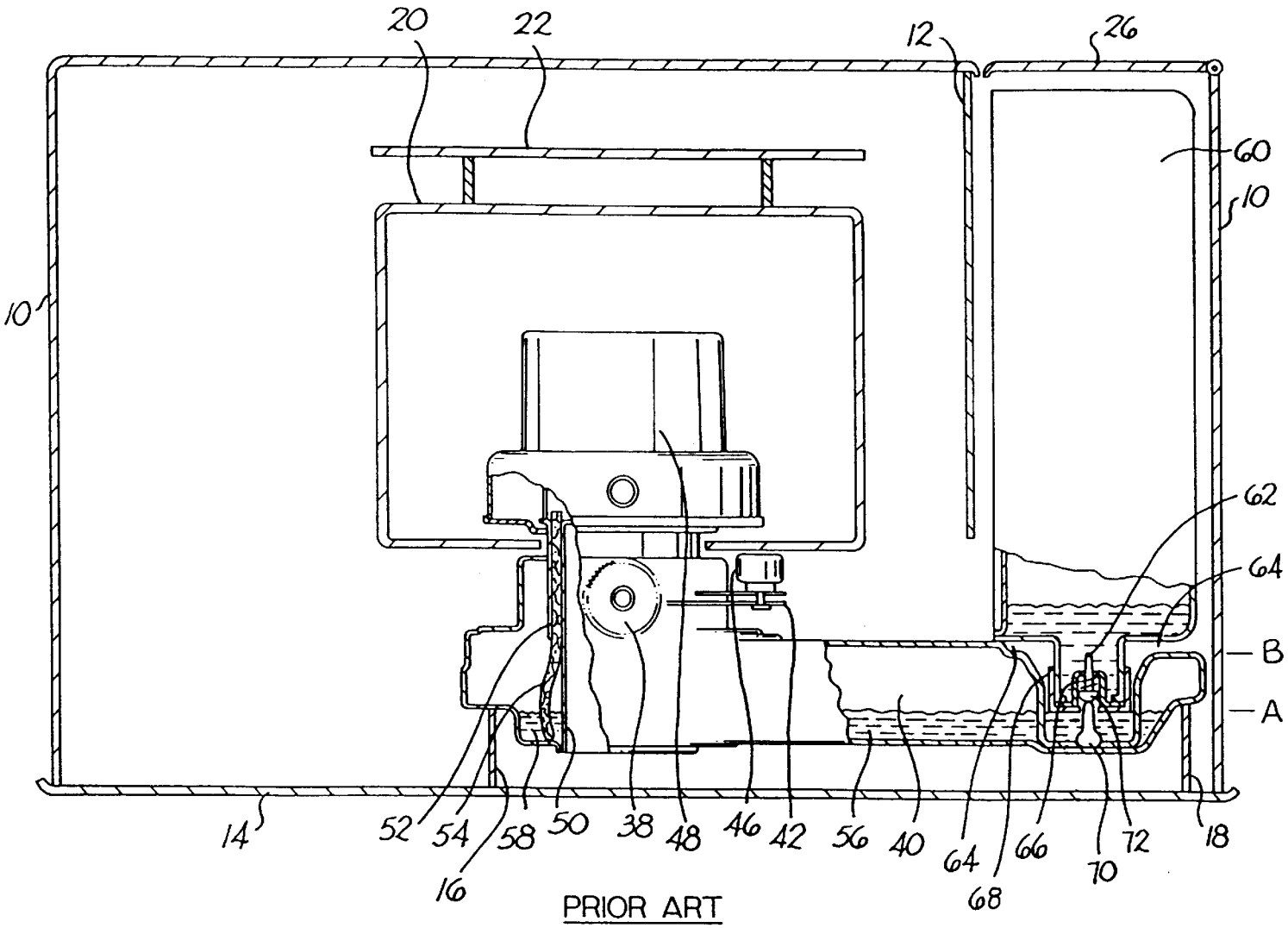
PRIOR ART FIG. 1
FIG. 1 is a side sectional view of a prior-art, wick-fed, barometric liquid fuel burner with a removable fuel tank, and an automatic wick extinguishing unit that can be activated by a vibration-sensing weight.

10 Cabinet
12 Tank guide
14 Basetray
16 Support
18 Support
20 Reflector
22 Heat shield
24 Inner equalization tube
26 Lid
28 Outer equalization tube
30 Chamber
32 Plate
34 Orifice
36 Opening
38 Wick gear
40 Fuel chamber
42 Automatic wick extinguishing unit
44 Fill tube
46 Vibration-sensing weight
48 Combustion cylinder
50 Inner wick guide
52 Outer wick guide
54 Wick
56 Fuel
58 Wick fuel supply reservoir
60 Removable fuel tank
62 Plunger
64 Opening
66 Plunger spring
68 Tank cap
70 Pin
72 Plunger head
74 Opening
76 Opening
78 Support
80 Support
82 Support
84 Support
86 Neck
88 Opening
A Normal fuel level
B Flooded fuel level

SUMMARY

In accordance with the present invention, an anti-flareup safety device for wick-fed, barometric liquid fuel burners regulates the flow of fuel from the removable tank into the fuel chamber, which prevents excess amounts of fuel from entering the fuel chamber, thereby preventing the flooding of the fuel chamber and flareup.

The safety device includes a fuel containment system in the removable tank to hold and restrict fuel egress from the removable tank. The system consists of a plate with an orifice, a fill tube, an inner equalization tube, an outer equalization tube, and a chamber.

Conventional Heater Structure—FIG. 1

FIG. 1 is a side sectional view of a conventional wick-fed barometric liquid-fuel burner (as described supra) that operates by burning a liquid fuel, such as kerosene. The burner is a wick-fed type with a combustion cylinder 48 and is constructed in a manner widely known in the art. One manufacturer of the burner of FIG. 1 is *Toyotomi of Japan,* and such manufacturer sells such burners under the trademark Kero-Sun.

In normal operation fuel is delivered from a removable fuel tank 60 to a horizontal fuel chamber 40 through an orifice in a tank cap 68 on tank 60. Tank 60 is held in a vertical position by tank guide 12 in cabinet 10 in accordance with the common practice of the industry. Cap 68, which is attached to the neck of tank 60, is inserted into a mating well, or sump, in the top surface of chamber 40, also the common practice in the industry.

When the fuel level in chamber 40 drops below level A due to fuel consumption by wick 54, air will bubble into tank 60 through orifice 74 in tank cap 68, and fuel (e.g., kerosene) will flow from tank 60 into chamber 40 until the level in chamber 40 reaches level A. A partial vacuum above the fuel in tank 60 maintains the fuel in tank 60 above level A until all of the fuel has been discharged from tank 60. Fuel 56, which is in fluid communication with wick 54, migrates by capillary action up wick 54 and is burned inside combustion cylinder 48, which generally consists of inner metal cylinders and an outer glass cylinder. Cylinder 48 provides a surface for the burning of the fuel, and radiates heat and some light. The flame is not shown, but is seen as a red glow in cylinder 48, above the wick.

Wick 54, cylindrical in shape and shown in a partial cross-sectional view, can be moved up or down by rotating a wick gear 38. Wick 54, wick guides 50 and 52, combustion cylinder 48, wick fuel supply reservoir 58, and vibration-sensing weight 46 in FIG. 1 are circular in shape when seen from above, whereas compartment 40 is generally rectangular. Removable fuel tank 60 is most commonly rectangular in shape as viewed from above, but various other shapes are also found, such as triangular. Tank cap 68 is cylindrical in shape, and is threaded to allow attachment to tank 60.

The fuel burner has an automatic wick extinguishing unit 42, which includes a vibration-sensing weight 46. If the burner is vibrated excessively, unit 42 disengages wick gear 38, which lowers wick 54, extinguishing the flame, or actuates any other wick extinguishing mechanism (not shown).

Operation and Danger of Flareup with Conventional Burner—FIG. 1

If the partial vacuum in tank 60 is lost, the barometric system of the burner of FIG. 1 no longer regulates fuel flow from tank 60. The partial vacuum may be lost by compromise of the integrity of tank 60, or by the presence of a high vapor pressure in tank 60, e.g., due to heating of tank 60. Most flareup incidents occur when a high-volatility fuel is inadvertently introduced into tank 60—most commonly, gasoline or gasoline-contaminated fuel. As a result, excessive fuel will flow into chamber 40. Since the capacity of tank 60 is about two liters (two quarts) greater than that of chamber 40, chamber 40 will not be able to contain all of the fuel from tank 60, if any significant amount of fuel is present in tank 60. As a result, fuel fills chamber 40 and when it reaches level B, overflows via opening 64 between tank 60 and the top of chamber 40.

The fuel spreads over the fuel chamber's surface and to other areas in the burner. The flooded fuel will ignite because the vapors from the leaked fuel are drawn by air movement toward the wick flame (not shown) in cylinder 48, which is of sufficient temperature to ignite these fumes. As a result, there will be flames in and around tank 60, causing the pressure inside tank 60 to increase dramatically, driving more fuel out of tank 60, which further increases the amount of escaped fuel, and accordingly increases the severity of the flareup.

The flareup incidents involving high-volatility fuels do not occur immediately after the burners are lit, but usually after an induction period of one or more hours. There is a delay because these burners are utilized for heating purposes at cooler ambient temperatures. At such temperatures, even the high-volatility fuels have vapor pressures low enough that the partial vacuum above the liquid in tank 60 is adequate to maintain the column of fuel in the tank, which requires a pressure differential of only approximately 3 kPa (0.4 psi) for the 36 cm (14 in) height typical of removable tanks.

For example, at 21° C. (70° F.) the vapor pressure of the most volatile class of gasolines Class E, is on the order of 69 kiloPascals (kPa), that is, about 10 pounds per square inch (psi). Since ambient pressure is around 101 kPa (14.7 psi), a column of gasoline nearly 5 m (15 ft) high could be maintained at such a pressure differential. However, should the temperature of the gasoline reach 38° C. (100° F.)—the approximate boiling point of gasoline—its vapor pressure will increase to about 101 kPa (14.7 psi), and the fuel will flow out of the removable tank and into the fuel chamber in an uncontrolled manner. This will circumvent the normal operation of the barometric valve. The increase in temperature of the air space in the removable tank during operation of the burner is not a significant factor in the loss of the partial vacuum in the removable tank. This is because the temperature increases are not rapid enough to overcome the normal action of the barometric valve in controlling fuel flow from tank 60 as fuel is consumed by the wick.

Unless the burner is in a very low temperature environment, the temperature of the removable tank will typically exceed 38° C. (100° F.) during operation of the burner. The removable tank achieves such temperatures due to its proximity, about 13 cm (5 in), to the combustion process, which reaches temperatures in excess of 850° C. (1600° F.), During operation of the burner, heat is transferred by radiation, convection, and conduction processes from the combustion cylinder to the removable tank.

The typical flareup scenario in such burners is as follows: Initially, the fuel in the removable tank is at a low enough temperature so that its vapor pressure is insufficient to allow liquid to flow from the removable tank beyond that allowed by the barometric valve. At this point, the liquid level in the fuel chamber will be maintained at the level of the barometric valve, which allows fuel to flow from the removable tank into the fuel chamber only as fuel is consumed by the wick. The temperature of the removable tank, as well as the fuel inside it, increases as thermal equilibrium is established in the burner, causing the vapor pressure of the fuel to increase. Then the increased vapor pressure of the fuel compromises the partial vacuum inside the removable tank, allowing fuel in the removable tank to flow into the fuel chamber in an uncontrolled manner. Since the capacity of the removable tank (4–5 liters) far exceeds that of the fuel chamber (1–2 liters), the fuel chamber fills and overflows. The vapors from the spilled fuel ignite and flareup ensues.

There is a second mechanism for flareup when high-volatility fuels are present. Vapors present in the sump area can be drawn to the wick flame by air currents, where they are ignited. Flames in the sump area heat the removable tank, causing it to dump its fuel in an uncontrolled manner, resulting in flareup.

With the exception of the above Henderson and Lightsey device (U.S. Pat. No. 5,338,185), the above Henderson tank-lift, pin drop, thermal barrier/fuel containment, vapor containment/tank-block, float/fuel shutoff and sump vapor containment devices (U.S. Pat. Nos. 5,456,595, 5,409,370, 5,549,470, 5,662,468, 5,730,115, and 5,772,425, respectively) and the above Henderson and Henderson device (U.S. Pat. No. 5,551,865), prior-art safety devices do not prevent flareup, but rather detect evidence that flareup has begun, and then trigger an automatic wick extinguishing unit, which acts to extinguish the flame on the wick. However, by the time flareup has begun, flames are outside the wick area, and extinguishment of the wick flame does not affect the progression of flareup. The flames are present where fuel has flooded, and the increasing amounts of fuel being discharged from the removable tank further increase the magnitude of the flareup incident, as described earlier.

The Henderson and Lightsey device (U.S. Pat. No. 5,338,185) is designed to extinguish the flame on the wick prior to flareup. However, if the wick shutoff mechanism fails to operate when activated as a result of the wick becoming encrusted, this device may not be able to prevent flareup. The Henderson tank-lift and pin-drop devices (U.S. Pat. Nos. 5,456,595 and 5,409,370, respectively) are designed to shut off fuel flow from the removable tank to the fuel chamber by separating the removable tank from the pin that opens the barometric device in the cap on the removable tank cap. However, these two devices have one feature in common: should they not operate properly to stop fuel flow from the removable tank, the fuel chamber may overflow and flareup may result.

The Henderson thermal barrier/fuel containment device (U.S. Pat. No. 5,549,470) is a very simple and effective device; however, fuel vapors in the vicinity of the removable tank may migrate over the walls of the fuel containment sump, which surrounds the removable tank, and may be drawn to the wick flame by the air movement in the burner, where they could be ignited. Also, the added components will increase the weight of the burner. The Henderson vapor containment/tank block mechanism (Ser. No. 08/514,583) is quite simple and effective. However, in order to contain an amount of fuel equal to the full capacity of the removable tank, this device requires either a) the incorporation of two additional compartments (beyond the fuel chamber), or b) the incorporation of one additional compartment, and an increase in the capacity of the fuel chamber. The Henderson sump vapor containment device (U.S. Pat. No. 5,472,425) acts to contain vapors in the sump area. Should excess fuel enter the fuel chamber, however, flareup may not be prevented.

The Henderson and Henderson thermocouple/solenoid device (U.S. Pat. No. 5,551,865) provides a self-test of the system each time the burner is operated. However, it requires incorporation of electrical circuits and components, and depends upon the proper functioning of the automatic wick shutoff mechanism. The Henderson float/fuel shutoff device is designed to block fuel flow into the fuel chamber when excess fuel is lost from the removable tank. Should the float not respond, or if the opening for fuel flow does not close properly, flareup may result.

Thus, prior-art safety devices, such as those which monitor excessive vibration of the burner, which detect high levels of $CO_2$ and low levels of $O_2$, which detect abnormal combustion, and which regulate the position of the wick to prevent excessive flaming, are ineffective in preventing flareup. The safety device described in the Josephs patent, supra, does not prevent flareup, but rather provides a wick-drop mechanism, and cuts off fuel flow through a fuel line after the onset of flareup. Since the wick-fed barometric liquid fuel burners in common use do not utilize a fuel line, Josephs' device is not applicable to them.

The Henderson and Lightsey, and the Henderson tank-lift, pin-drop, and float/fuel shutoff devices (U.S. Pat. Nos. 5,338,185, 5,456,595, 5,409,370, and 5,730,115, respectively) are designed to prevent flareup, but should they not operate properly, flooding of the fuel chamber may occur, and flareup may result. In the case of the Henderson thermal barrier/fuel containment device (U.S. Pat. No. 5,549,470), the additional components will increase the weight of the burner. To be most effective, the Henderson vapor containment/tank block device (U.S. Pat. No. 5,662,468) requires either the incorporation of two separate compartments as an adjunct to the fuel chamber, or an increase in the capacity of the fuel chamber and incorporation of one additional compartment. The Henderson vapor containment device (U.S. Pat. No. 5,662,468) may not prevent flareup should excess fuel enter the fuel chamber. The Henderson and Henderson thermocouple/solenoid device (U.S. Pat. No. 5,551,865) is designed to actuate the wick shutoff mechanism. However, should that mechanism fail to respond, e.g., due to the wick becoming encrusted, flareup may result.

Figure 2:
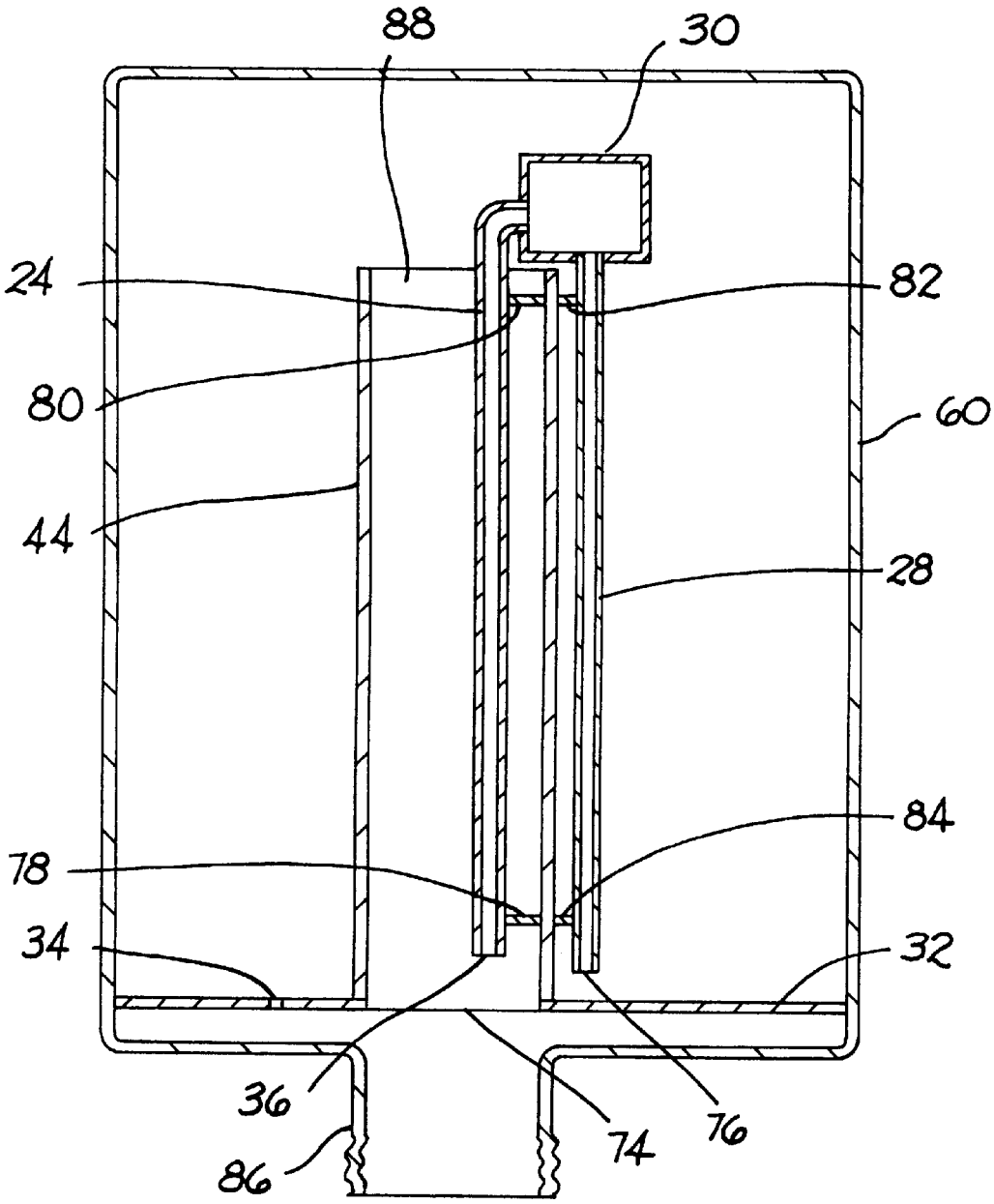
FIG. 2 is a side sectional view of a removable fuel tank with an anti-flareup safety device in accordance with the preferred embodiment of the present invention.

Description of Inventive Anti-Flareup Device—FIG. 2

Thus while many types of safety devices are known, these devices have not yet been incorporated in liquid fuel burners; accordingly, flareups and fires continue to occur, causing loss of life, injury, and property damage. An improvement over the earlier anti-flareup devices which overcomes the problem of loss of excess fuel from the removable tank due to high-volatility fuels, and thereby reduces the likelihood of flareups and fires, is illustrated in FIG. 2, which shows a removable and refillable tank with our inventive addition. It operates by providing a system that regulates fuel flow from a removable fuel tank 60 into the fuel chamber (not shown but similar to that of FIG. 1). It includes the following conventional elements: a tank cap 68, a plunger 62, a plunger spring 66, and a plunger head 72. In the typical fashion, as tank 60 is lowered into cabinet 10, pin 70 contacts plunger head 72, forcing it backward into cap 68, thereby allowing fuel in tank 60 to flow into fuel chamber 40.

In addition, tank 60 includes additional elements which constitute a preferred embodiment of the present inventive anti-flareup safety device. A plate 32 is located inside tank 60 near neck 86. Plate 32 extends completely across tank 60, and is liquid tight in its attachment to tank 60. Plate 32 is generally oval in shape. Its dimensions are about 15 cm (6 in) by 10 cm (4 in), and its thickness is about 0.25 cm (0.1 in). An orifice 34 is present in plate 32. Orifice 34, which is circular in shape, extends through plate 32, and is approximately 0.025 cm (0.01 in) in diameter.

In addition, a fill tube 44 is coupled with orifice 34 in plate 32 and extends upward from plate 32, terminating near the top of tank 60. Tube 44, which is cylindrical, is about 2.5 cm (1 in) in diameter and some 20 cm (8 in) long, with a wall thickness of around 0.1 cm (0.04 in). An inner equalization tube 24 is located inside tube 44, extending from near opening 74 through the opposite end of tube 44, at which point tube 24 connects to the top of the side of chamber 30. Tube 24, which is cylindrical, is about 20 cm (8 in) long and 0.5 cm (0.2 in) in diameter.

Outer equalization tube 28 is slightly shorter (19 cm (7.5 in)) and wider (1 cm (0.4 in)) than tube 24. Tube 28 is connected to the bottom of chamber 30, and extends along the outside of tube 44, terminating just above plate 32. Chamber 30 is cylindrical and is about 5 cm (2 in) long and 2.5 cm (1 in) in diameter. Tube 24 is connected to fill tube 44 by supports 78 and 80, and tube 28 is connected to tube 26 by supports 82 and 84.

Supports 78, 80, 82 and 84 have dimensions of about 1 cm (0.4 in) by 1 cm (0.4 in), and a thickness of 0.25 cm (0.1 in). Plate 32, tube 24, tube 28, tube 44, chamber 30, and supports 78, 80, 82 and 84 are preferably metal.

Operation of Inventive Anti-Flareup Device—FIG. 2

After operation of the burner for a period of time, tank 60 will become depleted of fuel, and the wick flame will extinguish. Should further operation of the burner be desired, it is necessary that tank 60 be refueled. The refueling procedure consists of removing tank 60 from the burner, inverting the tanks removing cap 68, and introducing fuel into tank 60. As fuel enters tank 60, it will flow through opening 74 in fill tube 44, and begin to fill tank 60. The air in tank 60 that is being displaced by the fuel will exit the tank through opening 88 and out tube 44, until fuel covers opening 88. As fuel continues to enter tank 60, air will flow into opening 76, and through equalization tube 28, chamber 30 and equalization tube 24, ultimately egressing through opening 36. Thus tube 28, chamber 30, and tube 44 constitute an air-equalization system for allowing tank 60 to be filled even though the fuel covers opening 88 in fill tube 44.

After the fueling process is completed, cap 68 is replaced on tank 60, which is inverted and inserted into the burner in the usual fashion. The fuel inside tube 44 will flow to the vicinity of cap 68, where it passes through the barometric valve. The fuel outside tube 44 and above plate 32 must pass through orifice 34 before it can pass through the barometric valve. Makeup air to replace the fuel passing through orifice 34 enters through tube 44. The fuel flow through orifice 34 will not be affected by pressure variations inside tank 60, even if a high-volatility fuel is present. This is because tube 44 provides equilibration to both sides of plate 32, where orifice 34 is located.

Should tank 60 contain some fuel above plate 32 at the time of re-fueling, tube 28 will contain some fuel. When tank 60 is inverted in order to refuel it, the liquid in tube 28 will flow into chamber 30, which accommodates that fuel, and thus no fuel enters tube 24. In this way, during the fueling operation the passageway comprised of tube 24, chamber 30, and tube 28 will be clear of liquid. In addition, the passageway will not be subject to a siphoning action after tank 60 has been filled, and is inverted and inserted into the burner.

After ignition of the wick, the burner components begin to increase in temperature. The hottest location in the burner components is in the vicinity of cylinder 48, especially over it. During operation of the burner, tank 60 (FIG. 1) and the fuel inside, will become warmer, causing the vapor pressure of the fuel to increase. If a high-volatility fuel, such as gasoline, is present in tank 60, the vapor pressure of the fuel in tank 60 will increase to the point that the partial vacuum above the fuel will become compromised. The fuel inside tube 44 and below plate 32 will escape in an uncontrolled manner. On the other hand, the fuel above plate 32 that is outside tube 44 will be contained, and its flow through orifice 34 is not affected by pressure changes. Orifice 34 is sized such that it restricts fuel flow to a rate comparable to the fuel consumption rate.

ADVANTAGES

It is clear from the discussion above that the anti-flareup safety device is quite simple in constructions and can be readily incorporated in the removable fuel tanks of wick-fed barometric liquid fuel burners without affecting the remainder of the burner. Yet it will prevent flareup by providing a system that regulates the flow of fuel from the removable fuel tank.

The present device prevents the burning of fuel outside its intended site, that being at the wick, thereby saving fuel and reducing odor. Also, the device does not require any electrical power or electronic circuitry for the prevention of flareup. The device is quite simple, and it can readily be incorporated in the removable tanks in contemporary burners.

Clearly, the device will make wick-fed, barometric liquid fuel burners safer to operate, and accordingly, will at the same time reduce the expensive lawsuits resulting from flareup incidents, and will reduce the incidence of injury, loss of life, and property damage. As a result these burners will be easier to market.

RAMIFICATIONS AND SCOPE

Those skilled in the art can now appreciate from the foregoing description that the broad teachings of the present invention can be implemented in a variety of forms. Therefore, while the safety device has been described in connection with particular examples thereof, the true scope of the invention should not be so limited since other modifications will become apparent to the skilled practitioner upon a study of the drawings, specification and following claims.

For example, the shape and composition of the safety device can be varied, so long as its function is preserved.

Fill tube 44, inner equalization tube 24, outer equalization tube 28, and chamber 30 may have various cross-sectional shapes, such as square, rectangular, oval or other convenient shapes, and their locations may be changed, so long as their functions are preserved. Also, the diameter of tube 44 may be changed, so long as the opening is sufficient to allow fuel to be readily introduced into tank 60. The capacities of tube 24, tube 28, and chamber 30 may be varied, so long as the capacity of chamber 30 exceeds that of tube 28, and so long as air can flow readily through tube 24, tube 28, and chamber 30 during the fueling of tank 60, so as not to interfere with the fueling operation, and the diameter of tube 24 must be greater than that of tube 28.

The orifice may be located in some other location in the plate than that shown, and it may be one opening, or may consist of multiple openings, or it may be replaced with a tube or multiple tubes.

Also, the device may be connected to or used in combination with other safety devices, such as warning gauges, tank block features, or shutoff mechanisms.

Thus the scope of the invention should be determined, not by the examples given, but by the appended claims and their legal equivalents.

What is claimed is:

1. An apparatus for preventing flareup in a liquid fuel burner of the type comprising:

(a) a removable tank for holding liquid fuel, (b) a fuel chamber for receiving said fuel from said tank, (c) a sump opening in said fuel chamber where said fuel in said tank is transferred to said chamber, and (d) a combustion chamber having a wick, where said fuel chamber supplies said liquid fuel from said tank to said wick of said combustion chamber, the improvement comprising:

a fuel regulating system in said tank that regulates the rate at which said fuel leaves said tank when said tank is seated in said sump opening, said fuel regulating system comprising a plate and a fill tube in said tank, said plate containing an orifice.

2. An apparatus according to claim 1 wherein said plate is in said tank, said orifice in said plate regulating the rate at which said fuel leaves said tank when said tank is seated in said sump opening.

3. An apparatus according to claim 1 wherein said plate is in said tank, said orifice in said plate regulating the rate at which said fuel leaves said tank when said tank is seated in said sump opening, and further including a fill tube, said fill tube traversing said plate.

4. An apparatus according to claim 1 wherein said plate is in said tank, said orifice in said plate regulating the rate at which said fuel leaves said tank when said tank is seated in said sump opening, and further including (a) a fill tube, said fill tube coupled to said plate and extending into said tank and having an opening distal from said plate, and (b) an air equalization system for allowing air egress from said tank during the re-fueling of said tank, even after fuel covers said opening distal from said plate.

5. An apparatus according to claim 4 wherein said air equalization system comprises an inner equalization tube, a chamber coupled to said inner equalization tube, and an outer equalization tube coupled to said chamber.

6. A method for preventing flare-up in a liquid fuel burner of the type comprising a removable tank for holding liquid fuel, a fuel chamber, a sump in said fuel chamber where said liquid fuel in said tank is transferred to said chamber, and a combustion chamber having a wick, where said fuel chamber carries said liquid fuel from said removable tank to said wick of said combustion chamber, comprising regulating fuel flow of said liquid fuel from said tank when said tank is seated in said sump opening, said regulating fuel flow from said tank comprising providing a plate in said tank, said plate containing an orifice.

7. The method of claim 6, further comprising providing a fill tube in said tank, said fill tube coupled to said plate.

8. The method of claim 6, further comprising providing a fill tube, said fill tube coupled to said plate, and further providing an inner equalization tube, a chamber coupled to said inner equalization tube, and an outer equalization tube coupled to said chamber.

9. The method of claim 6, further comprising providing (a) a fill tube, said fill tube coupled to said plate and extending into said tank and having an opening distal from said plate, and (b) an air equalization system for allowing air egress from said tank during the re-fueling of said tank, even after fuel covers said opening distal from said plate.

10. An apparatus for preventing flareup in a liquid fuel burner comprising:

(a) a removable tank for holding liquid fuel, (b) a fuel chamber for receiving said liquid fuel from said tank, (c) a sump opening in said fuel chamber where said liquid fuel in said tank is transferred to said chamber, (d) a combustion chamber having a wick, where said liquid fuel chamber supplies said liquid fuel from said tank to said wick of said combustion chamber, and (e) regulating means for controlling the rate at which said liquid fuel leaves said tank when said tank is seated in said sump opening, said regulating means comprising a plate in said tank, said plate having an orifice that regulates the rate at which said fuel leaves said tank when said tank is seated in said sump opening.

11. An apparatus according to claim 10, further including a fill tube, said fill tube coupled to said plate.

12. An apparatus according to claim 10, further including a fill tube, said fill tube coupled to said plate and extending into said tank and having an opening distal from said plate, and further including an air equalization system for allowing air egress from said tank during the re-fueling of said tank, even after fuel covers said opening distal from said plate.

* * * * *